United States Patent [19]

Schmidt

[11] 4,136,604

[45] Jan. 30, 1979

[54] METHOD AND APPARATUS FOR SEPARATING INDIVIDUAL BLANKS OF A MULTIPLE CARDBOARD BLANK

[75] Inventor: Hugo Schmidt, Düsseldorf, Germany

[73] Assignee: Feldmühle Aktiengesellschaft, Düsseldorf-Oberkassel, Germany

[21] Appl. No.: 828,993

[22] Filed: Aug. 30, 1977

[30] Foreign Application Priority Data

Aug. 31, 1976 [DE] Fed. Rep. of Germany ..... 2639212

[51] Int. Cl.[2] ..... B26F 3/02

[52] U.S. Cl. ..... 93/36 A; 225/101

[58] Field of Search ..... 93/36 A; 225/101, 100, 225/103, 96.5; 83/378

[56] References Cited

U.S. PATENT DOCUMENTS

| | | | |
|---|---|---|---|
| 3,133,684 | 5/1964 | Wiltshire et al. | 225/101 |
| 3,152,499 | 10/1964 | Moelbert | 83/378 X |
| 4,041,847 | 8/1977 | Spengler | 93/36 A |

*Primary Examiner*—James F. Coan

*Attorney, Agent, or Firm*—Hans Berman

[57] ABSTRACT

The individual cardboard box blanks of strings of blanks connected by scored, frangible bridge portions are separated by stacking the multiple blanks, clamping the stack of leading individual blanks to a vibratory support and the stack of the remainder of the blanks to a stationary feed table in such a position that the connecting bridge portions are free to flex and ultimately break when the support is oscillated about a position in which the blank-carrying surfaces of the support and of the table are spacedly aligned in a common plane.

12 Claims, 1 Drawing Figure

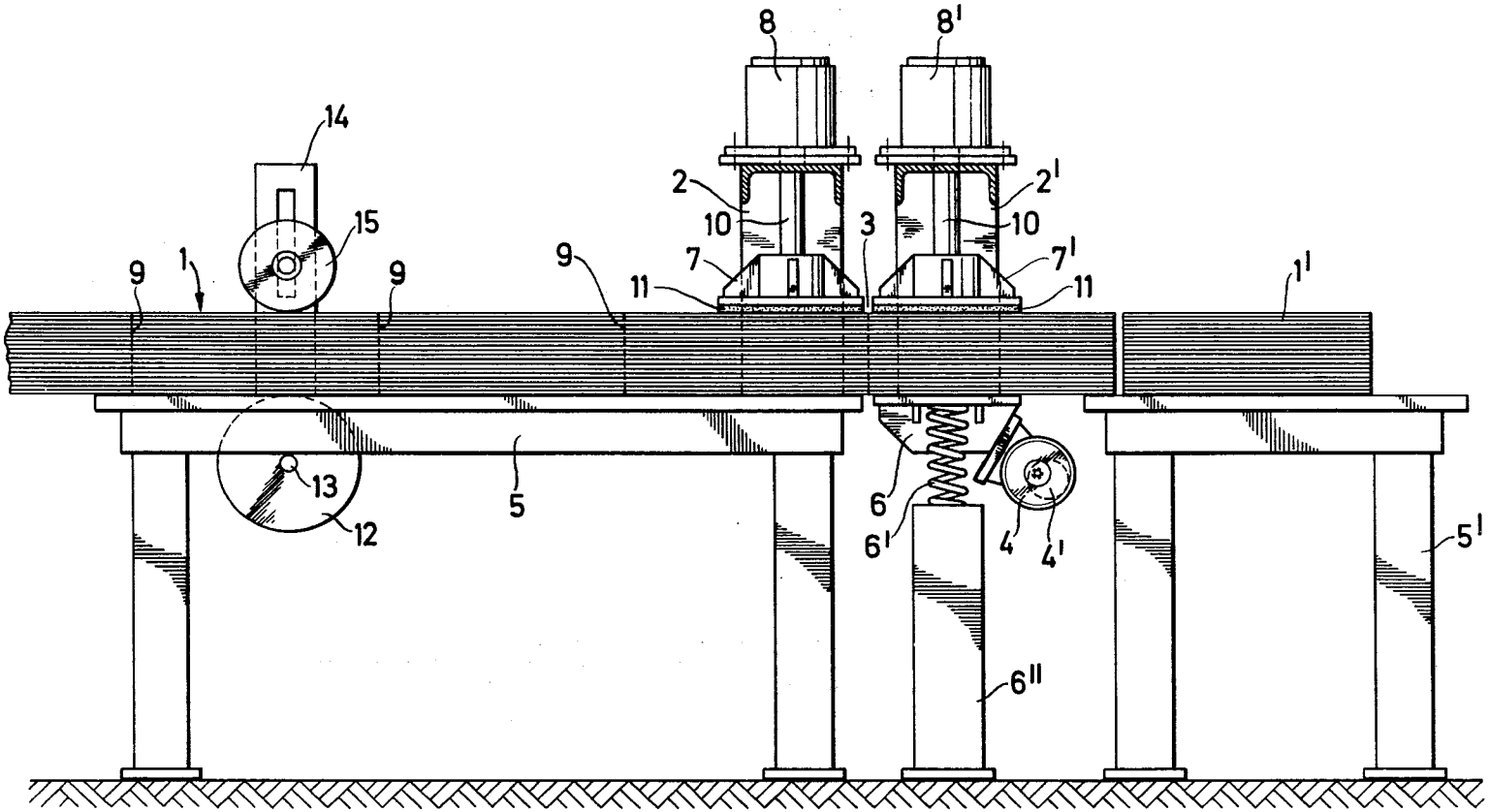
1
1'
2
2'
3
4
4'
5
5'
6
6'
6''
7
7'
8
8'
9
10
11
12
13
14
15

METHOD AND APPARATUS FOR SEPARATING INDIVIDUAL BLANKS OF A MULTIPLE CARDBOARD BLANK

This invention relates to the processing of sheet material, and particularly to a method and apparatus for dividing multiple blanks of sheet material.

The invention will be described hereinbelow in its application to the manufacture of boxes from cardboard including corrugated cardboard, but other uses will readily suggest themselves. It is common practice to subject long or continuous webs of cardboard to a cutting and scoring operation between dies of a reciprocating or rotary press. The sheet material is discharged from the press as a long string of individual box blanks integrally connected to each other by bridge portions made frangible by scoring and/or reduced cross section. The blanks were usually separated heretofore from each other manually by tearing the bridge portions. It would be impractical to break each bridge portion in a separate operation, and several strings of blanks are superimposed during the manual separating operation which requires considerable strength.

Attempts have been made to mechanize the operation to some degree but have had limited success. Pneumatically operated, hand-held chisels are effective, but have been found to damage more blanks than can be tolerated in many instances. Cutting blades moving in a plane transverse to the direction of string elongation need very precise adjustment to produce a clean cut, but there may be dimensional differences between nominally identical, successive blanks of the same string to vitiate all efforts at adjustment.

The primary object of this invention is a method which permits a string of blanks to be separated into the individual blanks in an efficient manner without or with only minimal intervention of a human operator regardless of dimensional differences between successive blanks.

Another object is the provision of apparatus for performing the method.

With these and other objects in view, the invention in one of its more specific aspects resides in a method of dividing each multiple blank of a plurality of multiple blanks, or strings of blanks, of sheet material, wherein each multiple blank includes a terminal, individual blank integrally connected to the remainder of the string by a frangible bridge portion in the direction of string elongation. According to the invention, several strings of blanks are superimposed on each other transversely to the direction of elongation in such a manner that the terminal, individual blanks of the several multiple blanks or strings constitute a first stack, the remainders of the multiple blanks constitute a second stack, and the bridge portions are interposed between the two stacks in superimposed relationship. The individual blanks of the first stack are releasably fastened to each other, and the blank remainders of the second stack are similarly fastened to each other. One of the stacks then is moved, and preferably reciprocated or oscillated, transversely to the direction of string elongation until the bridge portions are broken.

Apparatus of the invention for performing the aforedescribed method includes a first and a second support which define a first supporting surface and a second supporting surface respectively, devices being provided for moving one support relative to the other toward and away from a position of at least substantial alignment of the two surfaces in a common plane, the movement of the one support being transverse to the common plane. Clamping equipment on each support permits respective portions of the multiple blanks to be fastened to the two supporting surfaces, and the clamping devices are spaced from each other in a direction parallel to the common plane to provide space accommodating the bridge portions.

Other features, additional objects, and many of the attendant advantages of this invention will readily be appreciated as the same becomes better understood by reference to the following detailed description of a preferred embodiment of the invention when considered in connection with the appended drawing.

The sole FIGURE of the drawing shows blank-separating or dividing apparatus of the invention in side elevation.

The top surfaces of a feeding table 5 and of a receiving table 5' are horizontally aligned. A base 6'' carries a row of upright, helical compression springs 6' on which a rigig bar assembly 6 is mounted. The bar assembly has a flat top surface elongated transversely of the drawing plane which, in the illustrated condition of the apparatus, is flush with those of the tables 5, 5' at a small distance from the top of the feeding table 5, and somewhat farther from the receiving table 5'. The output shaft of an electric motor 4 mounted on the bar assembly 6 carries an eccentric weight 4'.

An upright bracket 2 on the table 5 and a similar bracket 2' on the bar assembly 6 carry the cylinders 8, 8' of two pairs of double-acting pneumatic motors, only one motor of each pair being visible in the drawing. The piston rods 10 of the motors carry rigid clamping plates 7, 7' which are elongated at right angles to the plane of the drawing so as to extend over the full width of the table 5 and the equal width of the bar assembly 6. The plates 7, 7' are separated by a narrow gap 3. The bottom faces of the plates 7, 7' face the top surfaces of the table 5 and of the bar assembly 6. Their long edges are rounded in a manner not capable of pictorial representation on the scale of the drawing, and they carry cushions 11 of foam rubber.

A drive roller 12 is mounted on the underside of the table 5 on the output shaft 13 of an electric motor, not otherwise shown, and passes through a slot in the table 5 into approximately tangential relationship with the top surface of the table. 1' vertically slotted bracket 14 on the feeding table surface guides a pressure roller 15, vertically aligned with the drive roller 12. Its weight and compression springs, not shown, bias the roller 15 downward.

In the illustrated condition of the apparatus, the leading portions of stacked multiple blanks 1 are partly supported on the feeding table 5, partly on the bar assembly 6, and partly on the receiving table 5' which also carries a stack of individual blanks 1'severed from the leading ends of the multiple blanks 1 in an earlier operation. The trailing portions of the multiple blanks 1 are not seen in the drawing and may extend to the power press in which the multiple blanks and the frangible bridge portions 9 which connect the several individual blanks of each multiple blank were formed in a conventional manner.

The multiple blanks 1 were fed forward by the cooperating rollers 12, 15 to the illustrated position in which the bridge connecting the leading individual blanks to the remainders of the multiple blanks are vertically aligned with each other and with the gap 3. The clamping plates 7, 7' were lowered to clamp the stack of leading, individual blanks to the top surface of the supporting bar assembly 6 and the next successive blanks in a second stack to the table 5. When the motor 4 thereafter is energized, the bridge portions vertically aligned with the gap 3 break quickly under the stresses applied by the oscillating bar assembly 6 due to rotation of the inert mass of the weight 4' about an axis remote form its center of gravity. Cooperating guide elements on the clamping plate 7' and the base 6'', conventional and not seen in the drawing, prevent lateral flexing of the springs 6' and thereby limit the bar assembly 6 to a vertical path of oscillation.

The motor 4 thereafter is stopped, the plates 7, 7' are retracted upward to release the respective stacks of blanks, and the drive motor of the roller 12 is operated long enough to shift the still connected blanks 1 forward by the length of one blank. The stack 1' is pushed off the receiving table 5' to a non-illustrated conveyor, another row of bridging portions 9 is aligned with the gap 3, and a new cycle can begin.

In an actual embodiment of the apparatus, the pneumatic clamping motors 8, 8', 10, the oscillator motor 4, and the drive motor for the feeding roller 12 were controlled automatically in response to an optical sensing device monitoring the arrival of bridging portions 9 in line with the gap 3. The automatic machine smoothly handled stacked, multiple blanks whose individual parts greatly differed from each other. Conventionally scored bridging portions broke cleanly along the scored lines under the cyclically alternating stresses.

It should be understood, of course, that the foregoing disclosure relates only to a preferred embodiment of the invention, and that it is intended to cover all changes and modifications of the example of the invention herein chosen for the purpose of the disclosure which do not constitute departures from the spirit and scope of the appended claims.

What is claimed is:

1. A method of dividing each multiple blank of a plurality of multiple blanks of sheet material, each multiple blank including an individual blank integrally connected to the remainder of said multiple blank in a predetermined direction by a frangible bridge portion, which method comprises:

(a) superimposing said multiple blanks on each other in a direction transverse to said predetermined direction in such a manner that the individual blanks of said multiple blanks constitute a first stack, the remainders of said multiple blanks constitute a second stack, and said bridge portions are interposed between said stacks in superimposed relationship;

(b) fastening the individual blanks of said first stack to each other;

(c) fastening the remainders of said second stack to each other; and (d) reciprocating one of said stacks of fastened blanks relative to the fastened blanks of the other stack in said transverse direction until the bridge portions of all said multiple blanks are broken.

2. A method as set forth in claim 1, wherein said one stack is oscillated in said transverse direction until said bridge portions are broken.

3. A method as set forth in claim 2, wherein the constituent elements of at least one of said stacks are releasably fastened to each other by clamping pressure applied in said transverse direction.

4. A method as set forth in claim 3, wherein said sheet material essentially consists of cardboard and said one stack is said first stack.

5. Apparatus for dividing multiple blanks of sheet material comprising:

(a) a first support and a second support having a first supporting face and a second supporting face respectively;

(b) first and second clamping means mounted on said supports respectively for fastening respective portions of the blanks to be divided to said faces; and (c) oscillating means for oscillating one of said supports and the clamping means mounted thereon relative to the other support toward and away from a position of substantial alignment of said faces in a common surface, (1) said oscillating means oscillating said one support and the clamping means mounted thereon transversely of said common surface, (2) said first and second clamping means being spaced from each other in a direction parallel to said surface in said position of alignment.

6. Apparatus as set forth in claim 5, wherein said faces and said surface are substantially planar.

7. Apparatus as set forth in claim 5, further comprising shifting means for shifting the blanks to be divided in said surface from said first face toward said second face.

8. Apparatus as set forth in claim 5, wherein said clamping means include means for holding the portions of said blanks fastened to the supporting face of said one support parallel to said supporting face during said oscillating.

9. Apparatus as set forth in claim 6, wherein said oscillating means include an inert mass having a center of gravity, and drive means for rotating said mass about an axis spaced from said center and fixed relative to said one support.

10. Apparatus as set forth in claim 5, wherein said clamping means each include a fluid operated motor mounted on the respective support, and a clamping plate having a face opposite the supporting surface of said support and drivingly connected to said motor for movement by said motor toward said supporting face.

11. Apparatus as set forth in claim 10, wherein said plate has a rounded edge bounding said face.

12. Apparatus as set forth in claim 11, further comprising a resilient cushion on said face.

* * * * *